US006539868B1

(12) United States Patent
Moulard

(10) Patent No.: US 6,539,868 B1
(45) Date of Patent: Apr. 1, 2003

(54) OPTICAL IGNITER WITH GRADED INDEX GLASS ROD

(75) Inventor: Henry Moulard, Saint Louis la Chaussee (FR)

(73) Assignee: Institut Franco-Allemand de Recherches de Saint-Louis (FR)

( * ) Notice: Subject to any disclaimer, the term of this patent is extended or adjusted under 35 U.S.C. 154(b) by 0 days.

(21) Appl. No.: 09/611,015

(22) Filed: Jul. 6, 2000

(30) Foreign Application Priority Data

Jul. 6, 1999 (FR) ..... 99 08717

(51) Int. Cl.[7] ..... F42C 19/00
(52) U.S. Cl. ..... 102/201
(58) Field of Search ..... 102/201

(56) References Cited

U.S. PATENT DOCUMENTS 3,528,372 A * 9/1970 Lewis et al. ..... 102/201
3,724,383 A * 4/1973 Gallaghan et al. ..... 102/201
3,812,783 A * 5/1974 Yang et al. ..... 102/201
4,343,242 A * 8/1982 Welk ..... 102/201
4,870,903 A * 10/1989 Carel et al. ..... 102/201
4,898,095 A * 2/1990 Tasaki et al. ..... 102/201
4,917,014 A * 4/1990 Loughry et al. ..... 102/201
5,179,247 A * 1/1993 Hawley ..... 102/201
5,914,458 A * 6/1999 Folsom et al. ..... 102/201
6,047,643 A * 4/2000 Benner et al. ..... 102/201

* cited by examiner

*Primary Examiner*—Charles T. Jordan
*Assistant Examiner*—Jordan M Lofdahl
(74) *Attorney, Agent, or Firm*—Bachman & LaPointe, P.C.

(57) ABSTRACT

An optical igniter includes a pyrotechnic substance and an optical fiber, one end of which is connected to a source of laser radiation and the other end of which is inserted in a connector. A removable mechanical connection is provided between the optical fiber connector and the pyrotechnic substance. A glass rod between the optical fiber connector and the pyrotechnic substance has its axis aligned with the axis of the optical fiber and is made of graded index glass in one part or two coaxial parts. It is in contact with the pyrotechnic substance and with the end of the optical fiber. Laser radiation from the end of the optical fiber passes through the glass rod and is focused onto the face of the glass rod in contact with the pyrotechnic substance.

19 Claims, 2 Drawing Sheets

OPTICAL IGNITER WITH GRADED INDEX GLASS ROD

BACKGROUND OF THE INVENTION

1. Field of the Invention

The present invention relates to an optical igniter comprising a pyrotechnic substance which is ignited by laser radiation fed to the pyrotechnic substance through an optical fiber.

2. Description of the Prior Art

In this type of optical igniter one end of the optical fiber is connected to a source of laser radiation and the other end of the fiber is inserted into a connector.

This type of optical igniter also includes means for providing a removable mechanical connection between the connector and the pyrotechnic substance.

An optical igniter of the above kind is described in an article published in 1997 in the journal "EG & G Optoelectronics" and entitled "Commercialization of a laser ignited actuator".

In practice, the manufacture of an optical igniter of the above kind encounters many problems with obtaining perfect transmission of the laser radiation without loss of energy between the optical fiber and the pyrotechnic substance.

The object of the present invention is to overcome the above problems by providing a low-cost energy-efficient optical igniter which is simple to manufacture and assemble and totally reliable in operation.

SUMMARY OF THE INVENTION

The invention therefore provides an optical igniter including a pyrotechnic substance, an optical fiber one end of which is connected to a source of laser radiation and the other end of which is inserted in a connector, means providing a removable mechanical connection between the optical fiber connector and the pyrotechnic substance, and a glass rod between the optical fiber connector and the pyrotechnic substance whose axis is aligned with the axis of the optical fiber and which is made of graded index glass in one part or two coaxial parts in contact with the pyrotechnic substance and with the end of the optical fiber so that laser radiation from the end of the optical fiber passes through the glass rod and is focused onto the face of the glass rod in contact with the pyrotechnic substance.

Because the manufacture of an igniter of the above kind does not raise the problem of very accurate alignment of the optical fiber and the graded index glass rod, it can be done at low cost using standard technical resources.

Also, inserting the aforementioned glass rod between the optical fiber and the pyrotechnic substance achieves perfect transmission of the laser energy to the pyrotechnic substance, which makes the operation of the igniter totally reliable.

The graded index glass rod is preferably inserted in a bore formed in a member made of a material that is a poor conductor of heat. The material that is a poor conductor of heat can be a metal that is a poor conductor of heat, which excludes copper and aluminum. The above member can instead be made of a ceramic material.

In one version of the invention the member made from a material that is a poor conductor of heat is cylindrical or frustoconical.

Other features and advantages of the invention will become more apparent in the course of the following description, which is given with reference to the accompanying drawings, which are provided by way of non-limiting example only.

DETAILED DESCRIPTION OF THE PREFERRED EMBODIMENTS

Figure 1:
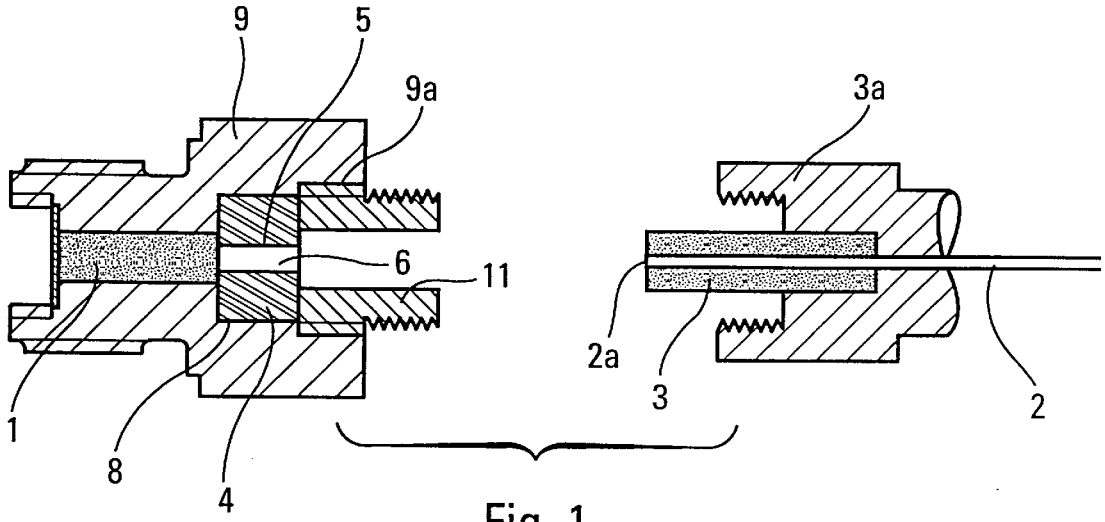
FIG. 1 is a view of an optical igniter according to the invention in longitudinal section.

In the embodiment of the invention shown in FIG. 1 the optical igniter contains a pyrotechnic substance 1 and an optical fiber 2 one end of which is connected to a source of laser radiation such as a laser diode.

The other end of the optical fiber 2 is adjacent the pyrotechnic substance 1 and is inserted into a connector 3 carried by a connecting ring 3*a*.

Means described in more detail below provide a removable mechanical connection between the connector 3 for the optical fiber 2 and the pyrotechnic substance 1.

In the example shown in FIG. 1, a member 4 made from a material that is a poor conductor of heat is inserted between the optical fiber connector 3 and the pyrotechnic substance 1. It includes a bore 5 whose axis is aligned with the axis of the optical fiber 2.

The bore 5 contains a graded index glass rod 6 one face of which is in contact with the pyrotechnic substance 1. The opposite face of the glass rod 6 is intended to come into contact with the end 2*a* of the optical fiber 2 after assembly.

Figure 2:
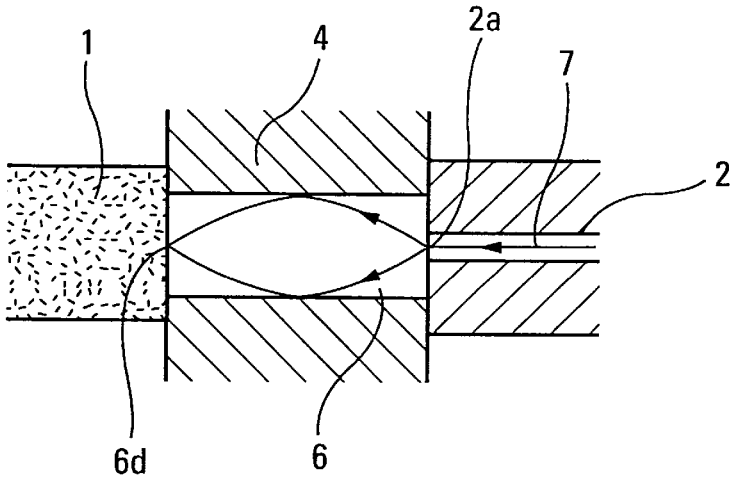
FIG. 2 is an enlarged view of the graded index glass rod.

Because the rod 6 is made of graded index glass, the laser radiation 7 (see FIG. 2) from the end 2*a* of the optical fiber 2 passes through the glass rod 6 and is focused onto the face 6*d* of the glass rod 6 in contact with the pyrotechnic substance 1.

The member 4 made of a material that is a poor conductor of heat can be made of a metal that is a poor conductor of heat, such as stainless steel. Metals such as copper and aluminum are not suitable.

The member 4 made of a material that is a poor conductor of heat can instead be made of ceramic.

In the example shown, the member 4 made of a material that is a poor conductor of heat is cylindrical.

As shown in FIG. 1, the cylinder 4 is housed in a cylindrical cavity 8 formed in a metal jacket 9 around the pyrotechnic substance 1. A terminal 11 is screwed into a screwthreaded bore 9*a* of the jacket 9 so that the terminal presses the cylinder 4 hermetically against the pyrotechnic substance 1.

The diameter of the graded index glass rod 6 can vary from approximately 1 mm to approximately 2 mm.

The length of the graded index glass rod is of the order of 5 mm.

Its length is such that the laser radiation 7 from the optical fiber 2 can be focused at its end.

The ratio of the length of the glass rod 6 to its diameter corresponds to the half-pitch optical characteristic of the graded index glass.

Figure 3:
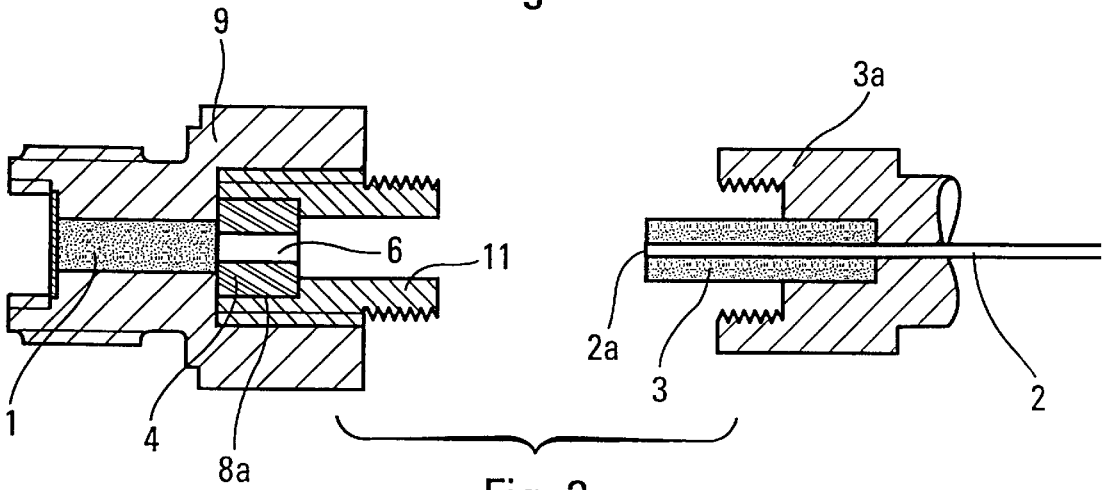
FIG. 3 is a view analogous to FIG. 1 showing a second version of the igniter according to the invention.

In the example shown in FIG. 3, the cylinder 4 which carries the rod 6 is housed in a cylindrical cavity 8*a* formed in the metal terminal 11*a* which surrounds the connector 3 for the optical fiber 2 after it is screwed into the metal jacket 9 which surrounds the pyrotechnic substance 1.

Figure 4:
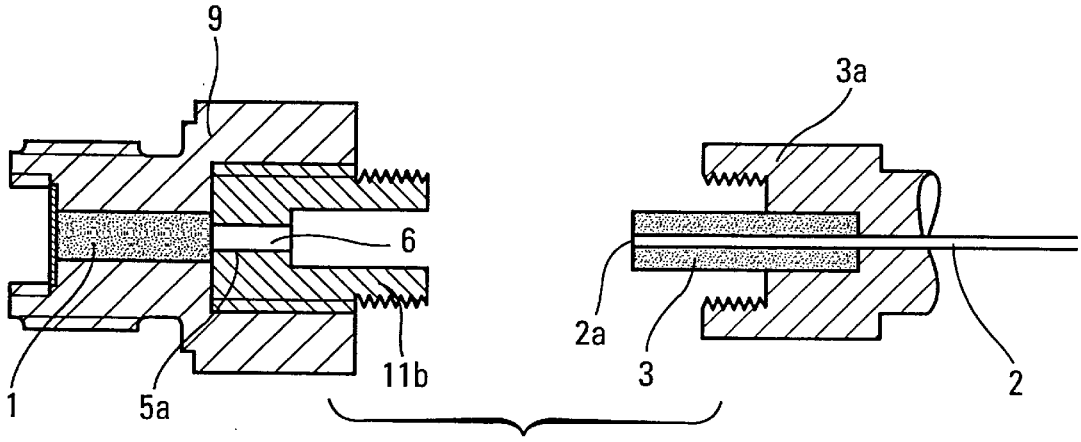
FIG. 4 is a view analogous to FIG. 1 showing a third version of the igniter according to the invention.

In the version shown in FIG. 4, the graded index glass rod 6 is housed in a bore 5*a* formed in the metal terminal 11*b* which surrounds the connector 3 for the optical fiber 2 after assembly and which is screwed into the metal jacket 9 which surrounds the pyrotechnic substance 1.

Figure 5:
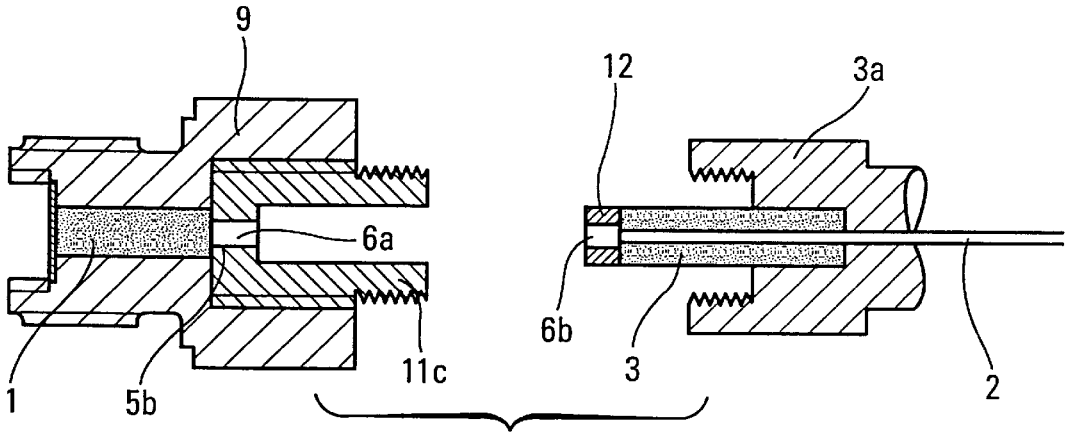
FIG. 5 is a view analogous to FIG. 1 showing a fourth version of the igniter according to the invention.

In the example shown in FIG. 5, the graded index glass rod is in two parts. A first part 6*a* of the graded index glass rod is housed in a bore 5*b* formed in a metal terminal 11*c* which after assembly surrounds the connector 3 for the optical fiber 2 and which is screwed into the metal jacket 9 which surrounds the pyrotechnic substance 1. A second part 6*b* of the glass rod is housed in a bore formed in a member 12 fixed to the end of the connector 3 for the optical fiber 2.

Figure 6:
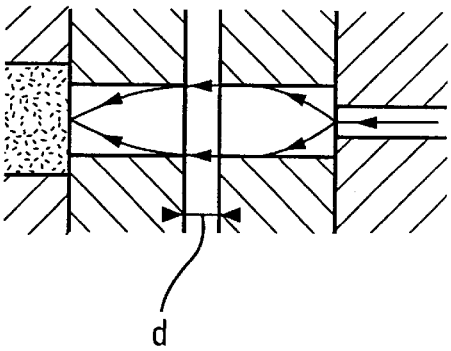
FIG. 6 is an enlarged view of the two-part glass rod of the igniter shown in FIG. 5.

FIG. 6 shows the disposition of the two rod parts 6*a*, 6*b* after screwing the ring 3*a* to the terminal 11*c*.

In this case, the ratio of the length to the diameter of each part 6*a*, 6*b* of the glass rod corresponds to the quarter-pitch optical characteristic of the graded index glass.

FIG. 6 also shows the path of the laser radiation in the two parts 6*a*, 6*b* of the graded index rod.

As in a rod in one part, the laser radiation is focused onto the end of the pyrotechnic substance 1.

FIG. 6 shows that there is a gap d between the two rod parts 6*a*, 6*b*. The distance d can vary from one igniter to another, compensates manufacturing tolerances and reduces fabrication and assembly costs.

The optical igniter just described has the following main advantages:

- the graded index glass rod 6 transmits the laser radiation 7 virtually without loss of energy (less than 5% loss), which enables the use of a laser source of lower-power, of the order of 1 W, such as a laser diode, and
- the fact that the glass rod 6 is carried by an easily machinable component facilitates assembling the glass rod to the igniter and aligning it with the optical fiber and also solves the problem of sealing the interior of the igniter from the external environment.

Of course, the invention is not limited to the example just described, to which many modifications can be made without departing from the scope of the invention.

What is claimed is:

1. An optical igniter including, a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber, being made of graded index glass and being in one part, and having a ratio of its length to its diameter corresponding to the half-pitch optical characteristic of said graded index glass, said glass rod being in contact by its exit face with said pyrotechnic substance and by its entry face with the other end of said optical fiber so that laser radiation from said other end of said optical fiber passes through said glass rod and is focused so as to meet in one focus point onto said exit face of said glass rod in contact with said pyrotechnic substance.

2. The optical igniter claimed in claim 1 wherein said graded index glass rod is inserted in a bore formed in a member made of a material that is a poor conductor of heat.

3. The optical igniter claimed in claim 2 wherein said material that is a poor conductor of heat is a metal that is a poor conductor of heat.

4. The optical igniter claimed in claim 2 wherein said member made of a material that is a poor conductor of heat is made of a ceramic material.

5. The optical igniter claimed in claim 2 wherein said member made from a material that is a poor conductor of heat is cylindrical.

6. An optical igniter including a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber and being made of graded index glass and being in at least one part, said glass rod being in contact with said pyrotechnic substance and with the other end of said optical fiber so that laser radiation from said other end of said optical fiber passes through said glass rod and is focused onto a face of said glass rod in contact with said pyrotechnic substance, said graded index glass rod being inserted in a bore formed in a member made of a material that is a poor conductor of heat, said member being made from a material that is a poor conductor of heat being cylindrical, said cylindrical member being housed in a cylindrical cavity formed in a metal terminal which surrounds said optical fiber connector and which is screwed into a metal jacket which surrounds said pyrotechnic substance.

7. An optical igniter including a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber and being made of graded index glass and being in at least one part, said glass rod being in contact with said pyrotechnic substance and with the other end of said optical fiber so that laser radiation from said other end of said optical fiber passes through said glass rod and is focused onto a face of said glass rod in contact with said pyrotechnic substance, said graded index glass rod being inserted in a bore formed in a member made of a material that is a poor conductor of heat, said member being made from a material that is a poor conductor of heat being cylindrical, said cylindrical member being housed in a cylindrical cavity formed in a metal jacket surrounding said pyrotechnic substance and said optical igniter further comprising a terminal which surrounds said optical fiber connector and is screwed into a screwthreaded bore of said metal jacket and which bears on a face of said cylindrical member opposite said pyrotechnic substance.

8. The optical igniter claimed in claim 7 wherein said graded index glass rod is housed in a bore formed in a metal terminal which surrounds said optical fiber connector and which is screwed into a metal jacket which surrounds said pyrotechnic substance.

9. An optical igniter including a pyrotechnic substance, an optical fiber one end of which is connected to a source of laser radiation and an other end of which is inserted in a connector, means for providing a removable mechanical connection between said optical fiber and said pyrotechnic substance, and a glass rod between said optical fiber connector and said pyrotechnic substance, said glass rod having an axis aligned with an axis of said optical fiber and being made of graded index glass and having a first portion and a second portion housed in a bore formed in a member fixed to an end of said optical fiber connector, the ratio of the length to the diameter of each portion of said glass rod corresponding to the quarter-pitch optical characteristic of said graded index glass, said first portion being in contact by an exit face with said pyrotechnic substance and said second portion being in contact by an entry face with the other end of said optical fiber so that laser radiation from said end of said optical fiber passes through said glass rod and is focused so as to meet in one focus point onto said exit face of said first portion in contact with said pyrotechnic substance, and said first portion being housed in a bore formed in a metal terminal which surrounds said optical fiber connector and which is screwed into a metal jacket which surrounds said pyrotechnic substance and said second portion being housed in a bore formed in a member fixed to an end of said optical fiber connector.

10. The optical igniter claimed in claim 9 wherein the ratio of the length to the diameter of each portion of said glass rod corresponds to the quarter-pitch optical characteristic of said graded index glass.

11. An optical igniter including a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber and being made of graded index glass and having a first portion and a second portion housed in a bore formed in a member fixed to an end of said optical fiber connector, the ratio of the length to the diameter of each portion of said glass rod corresponding to the quarter-pitch optical characteristic of said graded index glass, said first portion being in contact by an exit face with said pyrotechnic substance and said second portion being in contact by an entry face with the other end of said optical fiber so that laser radiation from said end of said optical fiber passes through said glass rod and is focused so as to meet in one focus point onto said exit face of said first portion in contact with said pyrotechnic substance.

12. The optical igniter claimed in claim 11 wherein said first portion and said second portion are coaxial.

13. The optical igniter claimed in claim 11 wherein said first portion is inserted in a bore formed in a member made of a material that is poor conductor of heat.

14. The optical igniter claimed in claim 13 wherein said material that is poor conductor of heat is a metal that is poor conductor of heat.

15. The optical igniter claimed in claim 13 wherein said member made of a material that is poor conductor of heat is made of ceramic material.

16. The optical igniter claimed in claim 13 wherein said member made of a material that is poor conductor of heat is cylindrical.

17. An optical igniter including a pyrotechnic substance, an optical fiber one end of which is connected to a source of laser radiation and an other end of which is inserted in a connector, means for providing a removable mechanical connection between said optical fiber and said pyrotechnic substance, and a glass rod between said optical fiber connector and said pyrotechnic substance, said glass rod having an axis aligned with an axis of said optical fiber and being made of graded index glass and having a first portion and a second portion housed in a bore formed in a member fixed to an end of said optical fiber connector, the ratio of the length to the diameter of each portion of said glass rod corresponding to the quarter-pitch optical characteristic of said graded index glass, said first portion being in contact by an exit face with said pyrotechnic substance and said second portion being in contact by an entry face with the other end of said optical fiber so that laser radiation from said end of said optical fiber passes through said glass rod and is focused so as to meet in one focus point onto said exit face of said first portion in contact with said pyrotechnic substance, said first portion being inserted in a bore formed in a member made of a material that is a poor conductor of heat, said member of said material that is a poor conductor of heat being cylindrical, and said cylindrical member being housed in a cylindrical cavity formed in a metal jacket surrounding said pyrotechnic substance and wherein said optical igniter further comprises a terminal which surrounds said optical fiber connector and is screwed into a screwthreaded bore of said metal jacket and which bears on a face of said cylindrical member opposite said pyrotechnic substance.

18. An optical igniter including a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber and being made of graded index glass and having a first portion and a second portion housed in a bore formed in a member fixed to an end of said optical fiber connector, the ratio of the length to the diameter of each portion of said glass rod corresponding to the quarter-pitch optical characteristic of said graded index glass, said first portion being in contact by an exit face with said pyrotechnic substance and said second portion being in contact by an entry face with the other end of said optical fiber so that laser radiation from said end of said optical fiber passes through said glass rod and is focused so as to meet in one focus point onto said exit face of said first portion in contact with said pyrotechnic substance, said first portion being inserted in a bore formed in a member made of a material that is a poor conductor of heat, said member made of said material that is a poor conductor of heat being cylindrical and said cylindrical member being housed in a cylindrical cavity formed in a metal terminal which surrounds said optical fiber connector and which is screwed into a metal jacket which surrounds said pyrotechnic substance.

19. An optical igniter including a pyrotechnic substance, an optical fiber one end of which is connected to a source of laser radiation and an other end of which is inserted in a connector, means for providing a removable mechanical connection between said optical fiber connector and said pyrotechnic substance, and a glass rod between said optical fiber connector and said pyrotechnic substance, said glass rod having an axis aligned with an axis of said optical fiber and being made of graded index glass and being in two coaxial parts, said glass rod being in contact with said pyrotechnic substance and with the other end of said optical fiber so that laser radiation from said other end of said optical fiber passes through said glass rod and is focused onto a face of said glass rod in contact with said pyrotechnic substance.

* * * * *